US010392935B2

(12) United States Patent
Farley et al.

(10) Patent No.: US 10,392,935 B2
(45) Date of Patent: Aug. 27, 2019

(54) MONITORING SYSTEMS AND METHODS

(71) Applicant: Expro North Sea Limited, Dyce, Aberdeenshire (GB)

(72) Inventors: Iain D. Farley, Theale (GB); Brian P. Champion, Wimborne (GB)

(73) Assignee: Expro North Sea Limited, Dyce (GB)

( * ) Notice: Subject to any disclaimer, the term of this patent is extended or adjusted under 35 U.S.C. 154(b) by 115 days.

(21) Appl. No.: 15/079,813

(22) Filed: Mar. 24, 2016

(65) Prior Publication Data

US 2017/0275991 A1 Sep. 28, 2017

(51) Int. Cl.

| | |
|---|---|
| ***E21B 49/08*** | (2006.01) |
| ***E21B 33/124*** | (2006.01) |
| ***E21B 47/06*** | (2012.01) |
| ***E21B 47/10*** | (2012.01) |

(52) U.S. Cl.

CPC ..... *E21B 49/088* (2013.01); *E21B 33/124* (2013.01); *E21B 47/06* (2013.01); *E21B 47/1015* (2013.01)

(58) Field of Classification Search

CPC .... E21B 33/24; E21B 47/1015; E21B 49/088; E21B 33/124; E21B 47/06

See application file for complete search history.

(56) References Cited

U.S. PATENT DOCUMENTS 2,618,341 A * 11/1952 Meddick ..... E21B 33/1294 166/113
4,008,763 A * 2/1977 Lowe, Jr. ..... E21B 43/04 166/253.1
4,196,619 A * 4/1980 Collins ..... E21B 47/1015 250/259

(Continued)

FOREIGN PATENT DOCUMENTS

EP 2878766 A1 * 6/2015 ..... E21B 47/06
WO WO 0063531 A1 * 10/2000 ..... E21B 47/1015

(Continued)

OTHER PUBLICATIONS

International search report for PCT/GB2017/050820 dated Jul. 20, 2017.

*Primary Examiner* — John Fitzgerald
(74) *Attorney, Agent, or Firm* — O'Shea Getz P.C.

(57) ABSTRACT

There are described methods and apparatus for determining the condition of a barrier in a well infrastructure, for example. In some examples, sensor data that has been derived from a sensor arrangement at a barrier positioned at a location in a well infrastructure in received. That sensor data may be associated with measured conditions at the barrier, or the like. Composition data derived from measurements of fluid composition within the well may also be received. Such composition data may be indicative of the location at which fluid has been in the well. Analyzing such received sensor data and composition data may help determine the condition of the barrier. In some examples, there is described well apparatus comprising a barrier for zonal isolation, a sensor arrangement configured to monitor conditions at the location of the barrier; and one or more tracer elements configured to interact with fluid at the location of the barrier so as to impart identifiable properties to the composition of fluid.

7 Claims, 2 Drawing Sheets

(56) References Cited

U.S. PATENT DOCUMENTS 5,635,712 A * 6/1997 Scott, III ..... E21B 43/26 250/260
5,892,147 A * 4/1999 Garnes ..... E21B 43/117 73/152.14
5,955,666 A * 9/1999 Mullins ..... E21B 23/02 340/853.1
6,349,766 B1 2/2002 Bussear et al.
6,645,769 B2 * 11/2003 Tayebi ..... E21B 47/1015 166/246
7,147,059 B2 * 12/2006 Hirsch ..... E21B 17/003 166/372
7,347,260 B2 * 3/2008 Ferguson ..... E21B 47/1015 166/250.12
8,322,414 B2 * 12/2012 Al-Gouhi ..... E21B 33/124 166/191
8,596,354 B2 * 12/2013 Hartshorne ..... E21B 47/1015 166/250.12
9,664,035 B2 * 5/2017 Nyhavn ..... E21B 47/1015
2001/0036667 A1 * 11/2001 Tayebi ..... E21B 47/1015 436/56
2003/0042026 A1 * 3/2003 Vinegar ..... E21B 33/1294 166/369
2007/0062708 A1 * 3/2007 McGregor ..... E21B 17/02 166/385
2008/0134775 A1 * 6/2008 Pipchuk ..... E21B 33/124 73/152.18
2009/0078427 A1 * 3/2009 Patel ..... E21B 43/10 166/372
2009/0266533 A1 * 10/2009 Baajiens ..... E21B 33/1208 166/66
2010/0089128 A1 * 4/2010 Vasshus ..... E21B 47/1025 73/40.5 R
2010/0170680 A1 * 7/2010 McGregor ..... E21B 17/02 166/385
2010/0212891 A1 * 8/2010 Stewart ..... E21B 23/00 166/250.12
2011/0240287 A1 * 10/2011 Hartshorne ..... E21B 47/1015 166/250.12
2011/0277996 A1 * 11/2011 Cullick ..... E21B 33/138 166/250.12
2011/0290480 A1 * 12/2011 Al-Gouhi ..... E21B 33/124 166/250.12
2013/0268198 A1 * 10/2013 Nyhavn ..... E21B 27/02 702/6
2014/0318770 A1 10/2014 Hallundbaek et al.
2015/0034305 A1 * 2/2015 Tips ..... E21B 47/12 166/250.01
2015/0068738 A1 * 3/2015 Wayne ..... E21B 47/06 166/250.11
2015/0068743 A1 * 3/2015 Broussard ..... E21B 43/04 166/278
2015/0211354 A1 * 7/2015 Richards ..... E21B 47/06 166/250.01
2016/0010454 A1 * 1/2016 Sira ..... E21B 47/1015 73/152.29
2016/0061003 A1 * 3/2016 Gottumukkala ..... E21B 34/16 166/250.07
2016/0201454 A1 * 7/2016 Nyhavn ..... E21B 27/02 73/152.51
2017/0022803 A1 1/2017 Nyhavn et al.
2017/0138187 A1 * 5/2017 Moronkeji ..... E21B 47/123

FOREIGN PATENT DOCUMENTS

WO WO 01/65053 * 9/2001 ..... E21B 17/00
WO WO2016200266 A1 12/2016

* cited by examiner

MONITORING SYSTEMS AND METHODS

BACKGROUND OF THE INVENTION

1. Technical Field

Described examples relate to systems, methods and other apparatus for use in monitoring wells, and in particular monitoring of well barriers.

2. Background Information

To help manage reservoir production and maximize recovery factor, the oil and gas industry sometimes adopts multi-zone intelligent completion technology, which allows production from particular reservoir "zones" to be controlled, often independent from one another. This may be achieved by selectively operating control valve or ports at the sections of tubing at some or all of the "zones". To provide effective zonal isolation, sometimes each zone may be isolated using annular barriers between sections of tubing. In order to understand present conditions at the formation and well infrastructure—and operate and/or maintain the well appropriately—aspects of the zones or completion may be monitored, e.g. from surface.

However, to provide effective control/maintenance of intelligent completion or the like, there may be a desire to monitor conditions accurately. Additionally, such monitoring may be desired for much of the lifespan of any well, e.g. from installation through to production, etc.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

In described examples, there are systems and methods for use determining conditions at a well. Particular examples may be for use in determining conditions at barriers associated with well infrastructure, for example, with intelligent completions. The systems and methods may provide effective control/maintenance of the well (e.g. and such completions), and may help monitor conditions accurately. Additionally, such systems and methods may be usable for much of the lifespan of any well, e.g. from completion through to production, etc.

In some examples, there is described a method for determining the condition of a barrier in a well infrastructure. The method may comprise receiving sensor data derived from a sensor arrangement at a barrier. That barrier may be positioned at a location in a well infrastructure. The sensor data may be associated with measured conditions at the barrier. The method may comprise receiving composition data derived from measurements of fluid composition within the well. Such composition data may be indicative of the location at which fluid has been in the well. The method may further comprise analyzing the received sensor data and composition data to determine the condition of the barrier.

The sensor data and/or composition data may be received from time to time, for example, during completion and/or production from the well. The sensor/composition data may be received periodically, e.g. hourly, daily, weekly or the like.

The sensor data may comprise pressure and/or temperature data associated with the barrier, or in the location of the barrier (e.g. at a particular zone). The composition data may comprise data associated with identifiable properties of fluid composition (e.g. product), which may be considered to be location-based identifiable properties. Such identifiable properties may be markers, such as chemical markers, or the like. The identifiable properties of fluid composition may be uniquely identifiable properties (e.g. specific to one location at the well). The composition data may comprise data associated with a plurality of identifiable properties (e.g. each of which may be associated with locations of fluid production in the well).

The barrier may be used to provide zonal isolation, i.e. isolation of one zone of the well infrastructure from another zone. In similar words, the barrier may be configured to isolate a first zone from a second zone. Such isolation may prevent or inhibit the movement of fluids or gases or the like from the first zone to the second zone, and vice versa. The barrier may be for use with tubing, such as production tubing, casing, completion tubing, such as casing, etc. The barrier may be formed between well tubing and the corresponding formation or reservoir. The barrier may be considered to be an annular barrier. The barrier may comprise one or more packers (e.g. two packers, axially spaced on tubing). The or each packer may comprise elements that activate, or have activated, in the presence of particular well conditions, such as particular fluid in an annulus, for example, an annulus formed between tubing and formation (e.g. swellable packers).

The barrier may be configured to prevent or inhibit fluid from flowing from a first zone at one side of the barrier to a second zone at another side of the barrier. The sensor data may provide data informing as to the barrier capability (e.g. barrier integrity). In similar words, the sensor data may inform on whether the fluid may be flowing from a first zone at one side of the barrier to a second zone at another side of the barrier, or not. Such information may be determined from monitoring fluid pressure and/or temperature at the barrier. The first zone may be intended to be an isolated zone, whereas the second zone may be intended to be a production zone.

The method may comprise authenticating, or otherwise validating, sensor data associated with the barrier when additionally the composition data confirms the location at which fluid is being produced as being from the first, or isolated, zone. The method may comprise discarding sensor data associated with the barrier when the composition data confirms the location at which fluid is being produced as being from the second, or production, zone. The method may comprise attributing sensor data associated with the barrier to flow conditions in the well, when the composition data confirms the location at which fluid is being produced as being from the second, or production, zone.

The method may further comprise signaling an alert status. Such an alert status may be signaled in the event that composition data confirms the location at which fluid is being produced as being from the first, or isolated, zone.

The method may comprise initially using essentially the received sensor data to determine conditions at the barrier, and then subsequently using essentially composition data to determine conditions at the barrier. For example, the method may comprise initially using essentially received sensor data during installation/completion and subsequently using composition data during production (e.g. later during production).

The sensor data may be received from a signal path that is wired, wireless or combination thereof. The sensor arrangement may comprise one or more sensors, each sensor configured to measure conditions at or in the location of the barrier. The sensor arrangement may be provided with well tubing (e.g. integrated with or otherwise affixed to well tubing). The sensor arrangement may be provided on an outer surface of such tubing. The sensor arrangement may comprise a power source, such as a battery pack, for powering a transmitter, etc., for communicating signals to surface, or the like.

The received sensor data may have been communicated using a signal path comprising some of the well tubing (e.g. the completion and/or production tubing, etc.). The sensor data may be received or otherwise extracted from the well tubing. The sensor data may have been communicated to, or otherwise injected into, the well tubing, for subsequent receipt. In other similar words, the sensor data may have been communicated from an isolated zone, for subsequent receipt, using the tubing. The received sensor data may be received at surface.

The fluid composition may be indicative of the location at which fluid has been in the well by virtue of an interaction (or lack of) of the fluid with one or more tracer elements at the barrier. Such tracer elements may be configured to release markers into the fluid when in contact with the fluid. The tracer elements may be provided at a first side of the barrier (e.g. at an isolated side). The tracer elements may be provided together with the sensor arrangements.

The method may additionally comprise receiving sensor data from the well infrastructure (e.g. directly). The method may comprise measuring the composition of fluid (e.g. produced fluid) to provide composition data. Alternatively, the method may comprise receiving sensor/composition data remotely.

The method may additionally comprise communicating the sensor data from a barrier location for subsequent receipt and analysis (e.g. at surface).

In some examples, there are described methods for determining condition of multiple barriers in one or more well infrastructures.

In some examples, there is described a method for determining the condition of a barrier in a well infrastructure, the method comprising: receiving sensor data derived from a sensor arrangement at a barrier positioned at a location in a well infrastructure, that sensor data associated with measured conditions at the barrier; receiving composition data derived from measurements of fluid composition within the well, the composition data being indicative of the location at which fluid has been in the well; and analyzing the received sensor data and composition data to determine the condition of the barrier.

In some examples, there is described a method for determining—or for permitting the determination of—the condition of a barrier in a well infrastructure.

The method may comprise collecting sensor data from a sensor arrangement at a barrier positioned at a location in a well infrastructure. That sensor data associated with measured conditions at the barrier.

The method may comprise collecting fluid samples for obtaining composition data from measurements of fluid composition within the well. That composition data may be indicative of the location at which fluid has been in the well.

The method may comprise communicating collected sensor data, fluid samples, and/or composition data in order to permit subsequent determination of the condition of the barrier using the communicated sensor data and composition data.

Any of the fluid samples, composition data and/or sensor data may be collected locally at the well infrastructure, and communicated to a remote location for subsequent analysis and determination of barrier condition.

In some examples, there is described a method for determining the condition of a barrier in a well infrastructure, the method comprising: collecting sensor data from a sensor arrangement at a barrier positioned at a location in a well infrastructure, that sensor data associated with measured conditions at the barrier; collecting fluid samples of fluid composition within the well in order to provide composition data, the composition data being indicative of the location at which fluid has been in the well; and communicating the collected sensor data and fluid samples and/or composition data in order to permit subsequent determination of the condition of the barrier using the sensor data and composition data.

In some examples, there is described a monitoring system configured to determine the condition of a barrier in a well infrastructure. The monitoring system may be configured to receive sensor data derived from a sensor arrangement at a barrier positioned at a location in a well infrastructure. That sensor data may be associated with measured conditions at that barrier. The system may be configured to receive composition data derived from measurements of fluid composition within a well. That composition data may be indicative of the location at which fluid has been in the well. The monitoring system may be configured to analyze received sensor data and composition data to determine the condition of a barrier.

The monitoring system may be configured to receive sensor data and composition data at the well infrastructure, or remotely from the infrastructure (e.g. received data via a network connection, or the like). In some examples, the sensor data together with composition data may be collected at the well infrastructure, and subsequently communicated remotely to the monitoring system for receipt and analysis in order to determine conditions associated with a barrier.

In some examples, there is described well infrastructure comprising at least one barrier, for example intended to provide zonal isolation, together with a sensor arrangement and tracer elements both positioned at the barrier. The sensor arrangement may be being configured to monitor conditions at the barrier and communicate sensor data associated with those conditions for subsequent receipt. The tracer elements may be configured to interact with fluid at the location of the barrier so as to impart identifiable properties to the composition of the fluid. The infrastructure may further comprise a monitoring system configured to receive sensor data from the sensor arrangement and to monitor the composition of fluid being produced by the well infrastructure so as to provide composition data associated with the composition of fluid in the well. The data system may be further configured to analyze sensor data and composition data to determine the condition of the at least one barrier.

The barrier may be an annular barrier provided by one or more packers. The barrier may be provided together with well-completion tubing, or the like. The sensor and elements may be provided at an isolated side of the barrier, e.g. isolated from production inflow.

In some examples, there is described well apparatus. The apparatus may comprise a barrier configured in use to provide isolation, such as zonal isolation. The apparatus may comprise a sensor arrangement configured to monitor conditions at the location of the barrier. The apparatus may comprise one or more tracer elements configured to interact with fluid at the location of the barrier, for example, so as to impart identifiable properties to the composition of fluid.

The sensor arrangement may be configured to measure pressure and/or temperature at the barrier. The tracer elements may be configured to impart uniquely identifiable properties to the composition of the fluid. Such identifiable properties may be markers, such as chemical markers, or the like, which may provide uniquely identifiable properties of the composition.

The apparatus may be comprised with, or otherwise mounted to, tubing.

The barrier may be configured to provide zonal isolation in use, i.e. isolation of one zone of a well infrastructure from another zone. In similar words, the barrier may be configured to isolate a first zone from a second zone. The tubing may be completion tubing, casing, production tubing or the like.

The barrier may be configured to activate from the tubing, such as casing, towards any corresponding formation, e.g. in order to seal one section of the well from another. The barrier may be considered to provide an annular barrier. The barrier may comprise one or more packers (e.g. two packers, axially spaced on tubing). The or each packer may comprise elements that are configured to activate in the presence of particular well conditions, such as particular fluid in the annulus formed between tubing and formation (e.g. swellable packers), or such as a particular pressure in the tubing and/or annulus (e.g. pressure applied from surface).

The barrier may be configured to prevent or inhibit fluid from flowing from a first zone at one side of the barrier to a second zone at another side of the barrier. The first zone may be intended to be an isolated zone, whereas the second zone may be intended to be a production zone.

The sensor arrangement may comprise one or more sensors, each sensor configured to measure conditions at or in the location of the barrier. The sensor arrangement may be provided with well tubing (e.g. integrated with or otherwise affixed to well tubing). The sensor arrangement may be provided on an outer surface of the tubing. The sensor arrangement may comprise a power source, such as a battery pack, e.g. for powering a transmitter to communicate signals to surface, or the like.

The sensor arrangement may be configured for wireless communication in as much as there the arrangement need not transmit data using a dedicated wired communication path. In similar words, the sensor arrangement may be configured to communicate wirelessly through the barrier. In some examples, the sensor arrangement may be configured to communicate using a signal path comprising the tubing (e.g. the completion and/or production tubing, etc.). The sensor arrangement may be configured to communicate to, or otherwise injected into, the tubing, for subsequent receipt. In other similar words, sensor data may be communicated from an isolated zone, for subsequent receipt, using the tubing. The received sensor data may be received at surface.

The fluid composition may be indicative of the location at which fluid has been in the well by virtue of an interaction (or lack of) of the fluid with one or more tracer elements at the barrier. Such tracer elements may be configured to release markers into the fluid when in contact with the fluid. The tracer elements may be provided at a first side of the barrier (e.g. together with the sensor arrangements).

In some examples, there is described well tubing, such as casing, comprising: a barrier configured in use to provide isolation, such as zonal isolation, a sensor arrangement configured to monitor conditions at the location of the barrier; and one or more tracer elements configured to interact with fluid at the location of the barrier so as to impart identifiable properties to the composition of fluid.

In some further described examples, there is a method for validating data from a sensor associated with an annular barrier in a well, comprising: receiving, via wired or wireless communication, data from a sensor, the data associated with monitored conditions at the annulus barrier; comparing the data with fluid composition being produced from the well; and validating the data from the sensor based on the composition of fluid.

In some examples, there is described a kit of parts comprising tubing, sensor arrangements and tracer elements configured, when assembled, to provide any of the systems/apparatus above. The kit of parts may be accompanying with assembly/use instructions.

In some examples, there is described a computer program product that when programmed into a suitable controller configures the controller to perform any methods disclosed herein. There may be provided a carrier medium, such as a physical or tangible and/or non-transient carrier medium, comprising the computer program product. The carrier medium may be a computer readable carrier medium.

The invention includes one or more corresponding aspects, embodiments or features in isolation or in various combinations whether or not specifically stated (including claimed) in that combination or in isolation. As will be appreciated, features associated with particular recited embodiments relating to systems may be equally appropriate as features of embodiments relating specifically to methods of operation or use, and vice versa.

It will be appreciated that one or more embodiments/aspects may be useful in effective control/maintenance of a well (e.g. and such completions), and may help monitor conditions accurately, for example, over the lifespan of any well, e.g. from completion through to production, etc.

The above summary is intended to be merely exemplary and non-limiting.

BRIEF DESCRIPTION OF THE DRAWINGS

A description is now given, by way of example only, with reference to the accompanying drawings, in which.

DESCRIPTION OF THE INVENTION

Figure 1:
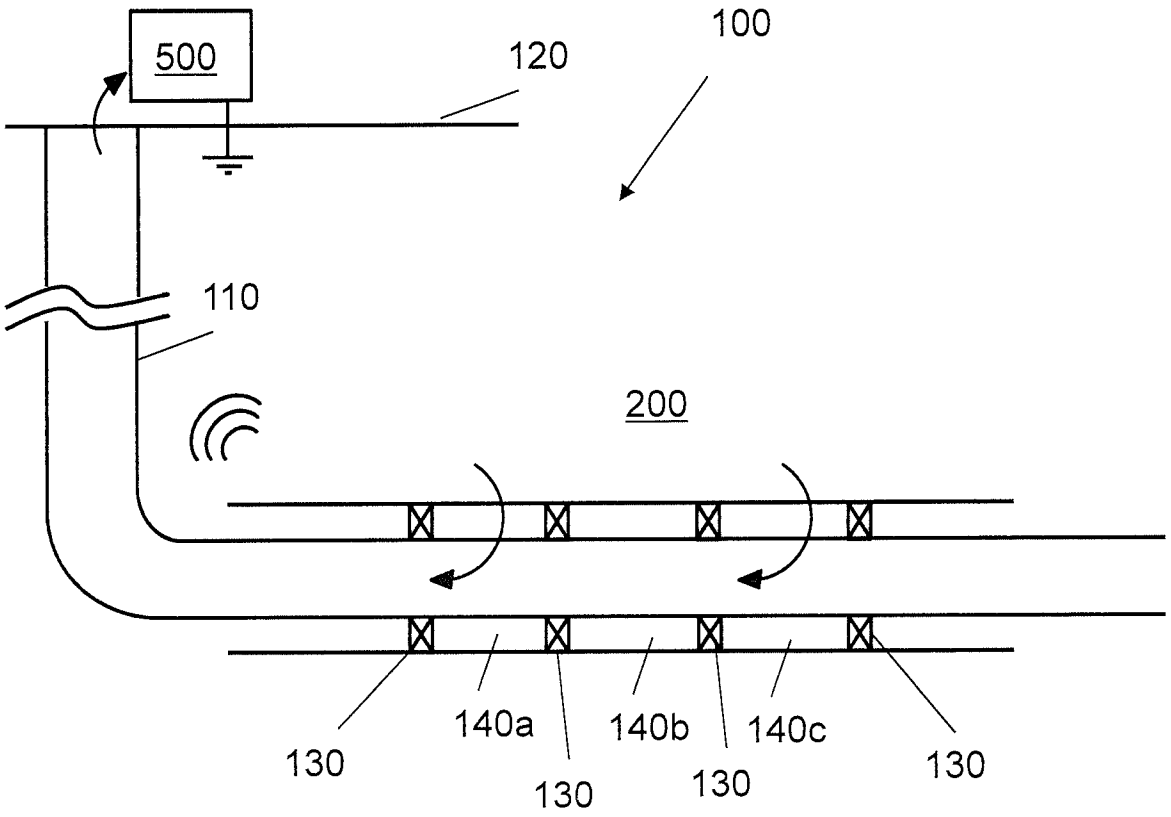
FIG. 1 shows an example of well infrastructure comprising isolated tubing using barriers and a monitoring system.

FIG. 1 shows an exemplary representation of a multi-zonal well infrastructure 100, in which sections of the well infrastructure 100 may be considered to be isolated from one another so as to permit controlled inflow of product or injection of fluids/gases from/to a formation 200.

For ease of reference, some of the following examples have been described specifically in relation to well infrastructures 100 using non-cemented barriers between casing and formation, and the monitoring of the condition of such barriers. However, a skilled reader will appreciate that in other examples the systems and methods described herein may also be used with monitoring of other barriers, such as those provided between other or multiple well annuli (e.g. barriers between production tubing and casing, or other such tubing). Similarly, while the well infrastructure 100 of FIG. 1 may be considered to show a deviated or horizontal well configuration, it will be appreciated that in other examples, the systems and methods may be used in vertical, or near-vertical sections of well, and indeed in mother bores and/or laterals.

Further, the examples described have been given with reference to oil and gas production, but of course in other examples, the systems and methods may be used with other fluid being produced and/or injected.

FIG. 1 shows a simplified representation of the well infrastructure 100 that comprises tubing 110 running from surface to a subterranean hydrocarbon bearing formation 200. At various sections of the infrastructure 100, there may be multiple annuli, as will be appreciated. However, for ease of representation, only a single tubing 110 is shown—albeit this may comprise production tubing, casing, etc. In the examples described below, attention is focused on the use of barriers that may be formed between tubing 110 and the formation. In such examples, such tubing 110 can be considered to be the casing of the well infrastructure, as will be appreciated by the skilled reader.

In this example, the tubing 110 runs horizontally through a section of the formation 200, as shown, and permits selective flow of product from the formation 200 to the tubing 110 for production to surface 120. In this case, rather than a cemented annulus between the tubing 110 (e.g. casing) and the formation 200, non-cemented annular barriers 130 are provided, which define a plurality of zones 140*a*, 140*b*, 104*c*, along some of the length of the tubing 110, and in this example between the tubing 110 and the formation 200.

Here, the formation 200 may be considered to be a carbonate formation, or fractured formation, or the like. As will be appreciated, such formations 200 can present particular challenges when achieving effective cement placement and bonding between the tubing (e.g. casing) and formation 200. These challenges are further accentuated where the well infrastructures 100 are deep and have complex trajectories. Problems to achieving effective cement placement include contaminated cement, channeling through the cement, and lost circulation of the cement into fractures in the formation.

Therefore, in this case, rather than providing conventional cement, alternative non-cemented barriers 130 are provided. Here, each barrier 130 may be considered to comprise swellable packers, configured to expand in the presence of specified fluids, such as water or oil. However, alternative/additional mechanically-actuated packers may be used, that are set by the application of pressure or by other mechanical means.

During installation and production, each barrier 130 is intended to provide zonal isolation. In doing do, production and/or injection at each zone can be controlled (e.g. using control valves or ports at the tubing 110, as is known). However, for such multi-zone intelligent completions to be effective, then the integrity of the barriers 130 should be maintained, where possible. Otherwise, any breach of the integrity of these barriers 130 may result in the high cost intelligent completion systems being ineffective.

For at least that reason, it may be helpful to monitor the condition of barriers (and zonal isolation), for example, in order to ensure integrity is being maintained. This may be desirable during early stage installation, production and injection testing and for longer term observation extending over several years.

Figure 2A:
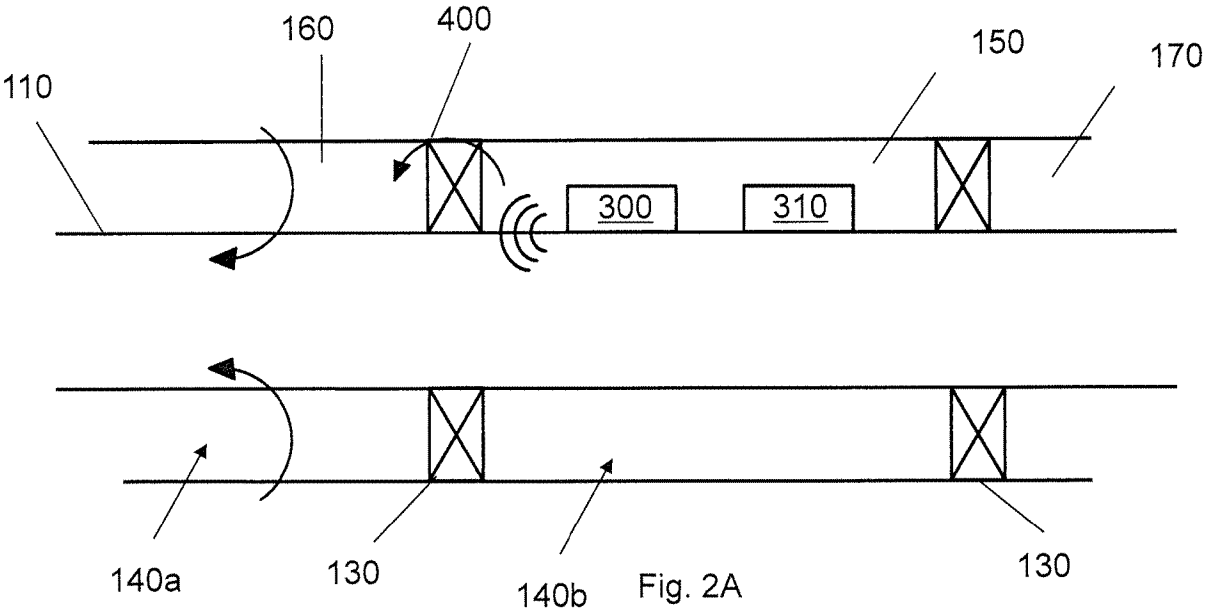
FIGS. 2A and 2B shows further detail of the tubing/barrier and monitoring system.

Consider now FIG. 2A, which shows a section of tubing 110 from the well infrastructure 100 of FIG. 1. Here, the barriers 130 may be considered to be provided on the outer surface of the tubing 110 (e.g. casing) and are configured to activate from the tubing 110 towards the formation 200 in order to seal one section of the well 100 from another. Here, barriers 130 provide an annular barrier. The barriers may comprise swellable packers or the like, configured to activate in the presence of particular well conditions, such as particular fluid in the annulus formed between tubing 100 and formation 200.

Here, the barriers 130 are configured to prevent or inhibit fluid from flowing from a first zone 150 at one side of a barrier 130 to a second zone 160 at another side of the barrier 130 (or indeed to a third zone). In this example, the first zone 150 can be considered to be an isolated zone, whereas the second zone 160 can be considered to be a production zone.

Here, a sensor arrangement 300 is positioned within the first zone 150 and is configured to measure conditions, such as pressure and/or temperature, at the barrier 130 (e.g. at the first zone 150), and provide sensor data accordingly. It will be appreciated that the sensor arrangement 300 may comprise one or more sensors, with each sensor being configured to measure particular conditions at or in the location of the barrier 130/zone 150. In some examples, the sensor arrangement 300 will be provided with well tubing 110 (e.g. integrated with or otherwise affixed to well tubing) prior to running into the well. As shown here, the sensor arrangement 300 is provided on an outer surface of the tubing 110. The sensor arrangement 300 may comprise a power source, such as a battery pack, e.g. for powering a transmitter to communicate signals to surface, or the like.

In this example, the sensor arrangement 300 is configured for communication to surface using at least a wireless connection across the barrier 130. As such, there is no need to transmit data using a dedicated wired communication path, which may otherwise penetrate or extend through the barrier 130, potentially reducing effectiveness, increasing risk or compromising lifespan of the barrier 130. While many methods of wireless communication may be possible, in this case the sensor arrangement 300 is configured to communicate sensor data using a signal path across the barrier 130 comprising the metallic tubing 110 itself (e.g. the casing and/or production tubing, etc.). In doing so, the sensor arrangement 300 is configured to communicate signals to, or otherwise injected signals into, the metallic tubing 110, for subsequent receipt from the tubing 110.

In some examples, the signal path may have a wireless connection across the barrier and the remainder, or at least most of the remainder, of the signal path to surface or otherwise may be wired. It will be appreciated that in this context, "wired" can include optical communication paths, or the like, as well as intermediate forms or apparatus for transferring data. In such cases, the signal path may be wired, wireless or combination thereof.

For example, data may initially be communicated wirelessly from the sensor arrangement located in the annular void, and received at a receiver or pick-up device positioned proximate the sensor arrangement. Subsequently, data may be communicated from the receiver to surface using wireline, or the like (or indeed wireless communication). In such cases, nonetheless, wireless communication can be used across the barrier helping maintain integrity. Of course, in other examples, wireless communication may be used from the barrier 130 to surface 110 (e.g. using the tubing to surface).

It will be appreciated that data may be communicated in real time, or may be communicated from time to time, and/or in response to a transmit request, for example, initiated from surface. In some cases, the data may be communicated in batch mode.

In any event, sensor data (i.e. data from the sensor arrangement that is associated with measured conditions at the barrier 130, zone 150) can be readily communicated from an isolated zone 150, for subsequent receipt at surface 120, using the tubing 110. Here, electromagnetic data communications technology, which transmits low frequency electromagnetic signals from downhole to surface, or surface to downhole, using the well's tubing or casing as the transmission medium may be used.

In use, detailed sensor data regarding conditions, such as pressure and/or temperature can be measured and communicated to surface 120. Such data may be desired when initially setting the barriers to ensure appropriate positioning installment. Also, however, as will be appreciated, certain variations in measured conditions may be linked with a change in barrier integrity over the life of the well, suggesting that in some cases the barrier 130 may have been compromised and that a flow path 400 has been established from the first zone 150 to the second zone 160 (or third zone 170).

In the event of barrier 130 failure, remedial action may be required, and potentially this action may be considered vitally urgent if the barrier 130 failure could result in loss of control of the well. Therefore, it will be appreciated that accurate monitoring of conditions, and the variations thereof, can be key to identifying barrier 130 failure and expeditiously taking appropriate action.

However, while conditions varying in the first zone 150 give rise to variations in measured conditions, the inventors have also discovered that, from time to time, variations in production fluids or injection fluids passing through the tubing 110 (or other thermally-driven fluctuation) can lead to measurement readings at the sensor arrangement 300 that spuriously suggest that the barrier 130 integrity may be compromised. In other words, accurate measurement of conditions—which may be required—can be difficult to achieve as the veracity of the data, or the confidence in that data, maybe in question. In some circumstances, this may lead to remedial action being performed that was otherwise not required.

Consider now therefore, the tubing of FIG. 2A. Here, in addition to the sensor arrangement 300, tracer elements 310 are additionally provided at the location of the tubing 110, at the first or isolated zone 150. Here, the tracer elements 310 are configured to impart identifiable properties to the composition of the fluid. Such identifiable properties may be markers, such as chemical markers, or the like, which may provide uniquely identifiable properties of the composition. It will be appreciated that a section of tubing 110, one or more barriers 130, together with sensor arrangement 300 and tracer elements 310 may be provided as complete sections for deployment in the well (e.g. a part of, or to complement, an intelligent completion system).

The fluid composition in the tubing 110 (e.g. being produced to surface 120) may be indicative of the location at which fluid has been in the well by virtue of an interaction (or lack of) of the fluid with tracer elements 310 at the barrier 130. In other words, if a barrier 130 has been compromised, then the fluid composition at surface 120 should indicate as much (albeit it may not provide suitably sufficient data regarding that condition, as per the sensor data).

Figure 2B:
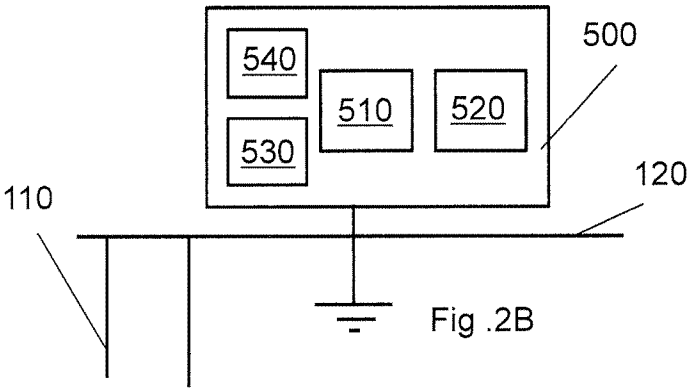

FIG. 2B shows a monitoring system 500 for use with the sensor arrangement 300 and tracer elements 310 of FIG. 2A. Here, the monitoring system 500 comprises a processor 510 and memory 520, configured in a known manner. The system 500 further comprises a receiver 530 for receiving sensor data communicated by the sensor arrangement. In this case, the receiver is configured to extract signals communicated in the metallic tubing 110 itself. Of course, in other examples the receiver may be configured to receive signals from wireline (e.g. e-line), or the like, or other signal path, from the sensor arrangement. Additionally, the monitoring system 500 comprises a composition analyzer 540 configured to measure fluid composition within the well, and provide corresponding composition data. That composition data may be indicative of the location at which fluid has been in the well, as will be appreciated.

While in this example, the monitoring system 500 is configured to receive sensor data and composition data at the well infrastructure 100, in other examples the system 500 may be configured to receive such data remotely from the infrastructure (e.g. received data via a network connection, or the like). In some examples, the sensor data together with composition data may be collected at the well infrastructure 100, and subsequently communicated remotely to the monitoring system 600 for receipt and analysis in order to determine conditions associated with a barrier 130. In some examples sensor data may be collected at the well infrastructure and communicated remotely for subsequent analysis. Similarly, fluid samples of fluid composition within the well may be collected and communicated to a remote location for analysis, or indeed composition data may be collected and communicated to a remote location. In such examples, collected sensor data, fluid samples and/or composition data may be communicated remotely in order to permit subsequent determination of the condition of the barrier using the sensor data and composition data.

In use, in order to determine the condition of a barrier 130 at a location in a well infrastructure 110, the system 500 (be it remote or local to the infrastructure, or combination thereof) initially receives sensor data associated with measured conditions at the barrier 130, or zone 150. Additionally, composition data of the fluid composition within the well 100 is obtained. The sensor data and/or composition data may be received from time to time, for example, during completion and/or production from the well. The sensor/composition data may be received periodically, e.g. hourly, daily, weekly or the like.

Here, the system 500 is configured to analyze the received sensor data and composition data to determine the condition of the barrier 130. In some examples, in the event that the sensor data suggests that an isolated zone 150 (e.g. a barrier 130) may be compromised, then the system 500 is configured to authenticate, or otherwise validate, the sensor data associated with that zone/barrier when the received composition data confirms the location at which fluid is being produced as being from the isolated zone (e.g. behind the barrier). In those cases, the system may be further configured to issue or otherwise signal an alert status in the event that composition data confirms the location at which fluid is being produced as being from the first, or isolated, zone. Alternatively, the system may be able to determine from the detailed sensor data that the compromise remains within acceptable limits, and take no immediate action.

Alternatively still, the system 500 may be configured to discard sensor data associated with the barrier 130 when the composition data confirms the location at which fluid is being produced as being from the second, or production, zone. In such cases, the system 500 may be configured to attribute sensor data associated with the barrier to flow conditions in the well, when the composition data confirms the location at which fluid is being produced as being from the second, or production, zone.

Additionally or alternatively it will be appreciated that in the above example, that the system 500 may be used for a period of the life of the well infrastructure 110. In doing, however, the power supply for the sensor arrangement 300 may deplete over time. Therefore, in some examples, the system 500 may be configured to initially use essentially the received sensor data to determine conditions at the barrier 130, and then subsequently use essentially composition data to determine conditions at the barrier 130. For example, the system 300 may be configured to use initially essentially received sensor data during installation/completion and subsequently using composition data during production. In doing so, detailed data can be obtained from the well during installation (e.g. detailed sensor data); while long term integrity can be monitored accordingly (using composition data).

Further, while in the above examples, reference has been made to one zone/barrier, it will readily be appreciated that multiple sensor arrangements/tracer element may be provided, which be associated with multiple isolated zones, or the like. In those cases, each tracer element may provide a unique marker accordingly in order to accurately confirm the sensor data.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the spirit or scope of the invention.

The invention claimed is:

1. A well monitoring apparatus, the well including tubing extending lengthwise within a wellbore of a formation, the tubing having an exterior surface, the apparatus comprising:

a first barrier configured to selectively create a first fluid flow barrier within an annular region disposed outside of the exterior surface of the tubing;

a second barrier configured to selectively create a second fluid flow barrier within the annular region disposed outside of the exterior surface of the tubing;

a sensor arrangement configured to sense a pressure and a temperature of a fluid disposed in a portion of the annular region disposed between the first barrier and the second barrier and produce sensor data representative of one or both of the sensed pressure and temperature;

one or more tracer elements disposed in the portion of the annular region disposed between the first barrier and the second barrier;

an analyzer configured to detect the presence of the one or more tracer elements within the fluid, and produce composition data representative thereof; and a processor in communication with the sensor arrangement, the analyzer, and a memory storing instructions, which instructions when executed cause the processor to analyze the sensor data and the composition data to produce information representative of the condition of the first barrier or the second barrier, or both.

2. The apparatus of claim 1, wherein the information representative of the condition of the first barrier or the second barrier, or both includes information relating to a fluid flow path across the first barrier, or a fluid flow path across the second barrier, or both.

3. The apparatus of claim 1, wherein the sensor arrangement is configured to communicate using a signal path comprising the tubing.

4. A well monitoring apparatus, comprising:

a monitoring system including a processor and a memory device;

a well conduit having an exterior surface;

a first barrier configured to selectively create a first fluid flow barrier within an annular region disposed outside of the exterior surface of the conduit;

a second barrier configured to selectively create a second fluid flow barrier within the annular region disposed outside of the exterior surface of the conduit;

a sensor arrangement configured to sense a pressure and a temperature of a fluid disposed in a portion of the annular region disposed between the first barrier and the second barrier and produces first sensor data representative of the sensed pressure and second sensor data representative of the sensed temperature, and communicate the first sensor data and the second sensor data to the processor; and one or more tracer elements disposed in the portion of the annular region disposed between the first barrier and the second barrier;

an analyzer configured to detect the presence of the one or more tracer elements within the fluid, and produce composition data representative thereof; and wherein the processor is in communication with the sensor arrangement, the analyzer, and the memory, wherein the memory includes storing instructions, which instructions when executed cause the processor to analyze the first sensor data, the second sensor data, and the composition data to produce information representative of the condition of the first barrier or the second barrier, or both.

5. A method for determining the condition of a barrier in a well infrastructure, the well infrastructure including tubing extending lengthwise within a wellbore of a formation, the tubing having an exterior surface, comprising:

using a sensor arrangement to sense a pressure and a temperature of a fluid disposed in a portion of an annular region disposed outside of the exterior surface of the tubing, the portion of the annular region disposed between a first barrier that forms a first fluid flow barrier within the annular region and a second barrier that forms a second fluid flow barrier within the annular region, and producing sensor data representative of one or both of the sensed pressure and temperature;

disposing one or more tracer elements disposed in the portion of the annular region disposed between the first barrier and the second barrier;

detecting the presence of the one or more tracer elements within the production fluid using an analyzer, and producing composition data representative thereof; and producing information representative of a condition of the first barrier or the second barrier, or both based on the sensor data, the composition data, and the production fluid being produced from the first or second zone.

6. The method of claim 5, wherein the first barrier is an annular barrier formed between the tubing and a corresponding formation.

7. The method of claim 5, wherein the step of producing information representative of said condition of the first barrier or the second barrier, or both based on the sensor data and the composition data, includes authenticating, or otherwise validating, the sensor data.

* * * * *